US012005330B2

(12) United States Patent
Montgomery et al.

(10) Patent No.: US 12,005,330 B2
(45) Date of Patent: Jun. 11, 2024

(54) DOUBLE-BARREL BALL BATS

(71) Applicant: EASTON DIAMOND SPORTS, LLC, Thousand Oaks, CA (US)

(72) Inventors: Ian Montgomery, Simi Valley, CA (US); Linda Hunt, Simi Valley, CA (US); Dewey Chauvin, Simi Valley, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 340 days.

(21) Appl. No.: 16/803,557

(22) Filed: Feb. 27, 2020

(65) Prior Publication Data

US 2021/0268352 A1 Sep. 2, 2021

(51) Int. Cl.

*A63B 59/56* (2015.01)
*A63B 59/59* (2015.01)
*A63B 102/18* (2015.01)

(52) U.S. Cl.

CPC ..... *A63B 59/56* (2015.10); *A63B 59/59* (2015.10); *A63B 2102/182* (2015.10)

(58) Field of Classification Search

CPC ..... A63B 59/51; A63B 59/54; A63B 59/56; A63B 59/58; A63B 59/59; A63B 2102/18; A63B 2102/182

USPC ..... 473/564, 566, 567

See application file for complete search history.

(56) References Cited

U.S. PATENT DOCUMENTS 2,967,710 A 1/1961 Carlson
3,623,724 A 11/1971 Lande
3,877,698 A 4/1975 Volpe
3,990,699 A 11/1976 Urmston
4,206,150 A 6/1980 Slaugh
4,331,330 A 5/1982 Worst
4,671,511 A * 6/1987 Trysinsky ..... A63B 49/035 473/552
4,930,772 A 6/1990 Maloney et al.
4,951,948 A 8/1990 Peng
5,050,877 A 9/1991 Wales
5,104,123 A * 4/1992 Okitsu ..... A63B 59/51 473/520
5,219,164 A 6/1993 Peng
5,415,398 A 5/1995 Eggiman
5,511,777 A 4/1996 Mcneely (Continued)

OTHER PUBLICATIONS

ASTM International, "F2844-11: Standard Test Method for Displacement Compression of Softball and Baseball Bat Barrels" USA Baseball ABI Protocol, edition approved Apr. 1, 2011, published May 2011. 3 pages.

(Continued)

*Primary Examiner* — Joseph B Baldori

(74) *Attorney, Agent, or Firm* — Perkins Coie LLP

(57) ABSTRACT

A ball bat includes an outer shell and an insert positioned in a ball striking area of the outer shell. The insert may include a tube element and one or more spacer elements positioned to form a gap between the tube element and the outer shell along at least a portion of a length of the tube element. In some embodiments, the insert or the gap may extend along only the length of the ball striking area. The outer shell may provide some compliance during a hit to create a trampoline effect, while the insert may provide a backstop to limit radial deflection of the outer shell.

14 Claims, 8 Drawing Sheets

(56) References Cited

U.S. PATENT DOCUMENTS

| | | | | |
|---|---|---|---|---|
| 5,593,158 | A | 1/1997 | Filice et al. | |
| 5,676,610 | A | 10/1997 | Bhatt et al. | |
| 5,899,823 | A | 5/1999 | Eggiman | |
| 5,964,673 | A | 10/1999 | Mackay, Jr. | |
| 6,022,282 | A | 2/2000 | Kennedy et al. | |
| 6,053,828 | A | 4/2000 | Pitsenberger | |
| 6,077,178 | A | 6/2000 | Brandt | |
| 6,159,114 | A | 12/2000 | Degaris | |
| 6,176,795 | B1 | 1/2001 | Schullstrom | |
| 6,251,034 | B1 * | 6/2001 | Eggiman | B29C 70/32 473/567 |
| 6,287,222 | B1 | 9/2001 | Pitsenberger | |
| 6,398,675 | B1 | 6/2002 | Eggiman et al. | |
| 6,425,836 | B1 | 7/2002 | Misono et al. | |
| 6,461,260 | B1 | 10/2002 | Higginbotham | |
| 6,497,631 | B1 | 12/2002 | Fritzke et al. | |
| 6,533,685 | B1 | 3/2003 | Otten et al. | |
| 6,612,945 | B1 | 9/2003 | Anderson | |
| 6,663,517 | B2 | 12/2003 | Buiatti et al. | |
| 6,723,012 | B1 | 4/2004 | Sutherland | |
| 6,733,404 | B2 | 5/2004 | Fritzke et al. | |
| 6,761,653 | B1 | 7/2004 | Higginbotham et al. | |
| 6,869,372 | B1 | 3/2005 | Higginbotham et al. | |
| 6,945,886 | B2 | 9/2005 | Eggiman et al. | |
| 6,949,038 | B2 | 9/2005 | Fritzke | |
| 6,969,330 | B1 | 11/2005 | Meeker | |
| 6,997,826 | B2 | 2/2006 | Sutherland | |
| 7,014,580 | B2 | 3/2006 | Forsythe et al. | |
| 7,033,291 | B1 | 4/2006 | Meeker et al. | |
| 7,044,871 | B2 | 5/2006 | Sutherland et al. | |
| 7,097,578 | B2 * | 8/2006 | Guenther | A63B 59/50 473/567 |
| 7,320,653 | B2 | 1/2008 | Fitzgerald et al. | |
| 7,527,570 | B2 | 5/2009 | Giannetti et al. | |
| 7,572,197 | B2 * | 8/2009 | Chauvin | A63B 60/54 473/567 |
| 7,585,235 | B2 | 9/2009 | Misono et al. | |
| 7,651,420 | B1 | 1/2010 | Gaff et al. | |
| 7,699,725 | B2 * | 4/2010 | McNamee | A63B 59/50 473/567 |
| 7,749,115 | B1 | 7/2010 | Cruz et al. | |
| 7,798,926 | B1 | 9/2010 | Hsu et al. | |
| 7,850,554 | B2 | 12/2010 | Burger | |
| 7,867,114 | B2 | 1/2011 | Sutherland et al. | |
| 7,980,970 | B2 | 7/2011 | Watari et al. | |
| 7,985,149 | B2 | 7/2011 | Watari et al. | |
| 7,993,223 | B2 | 8/2011 | Watari et al. | |
| 8,007,381 | B2 | 8/2011 | Watari et al. | |
| 8,029,391 | B2 | 10/2011 | McNamee et al. | |
| 8,313,397 | B2 | 11/2012 | Watari et al. | |
| 8,449,412 | B2 | 5/2013 | Vander et al. | |
| 8,480,519 | B2 | 7/2013 | Chauvin et al. | |
| 8,632,428 | B2 | 1/2014 | Burger | |
| 9,005,056 | B2 | 4/2015 | Pegnatori | |
| 9,067,109 | B2 | 6/2015 | Epling et al. | |
| 9,149,697 | B2 * | 10/2015 | Epling | A63B 60/54 |
| 9,498,690 | B2 | 11/2016 | Carlson et al. | |
| 9,669,277 | B1 | 6/2017 | Haas et al. | |
| 10,220,277 | B1 | 3/2019 | Hunt et al. | |
| 10,561,914 | B2 * | 2/2020 | Tsukamoto | A63B 59/56 |
| 10,773,138 | B2 | 9/2020 | Epling et al. | |
| 11,058,934 | B2 * | 7/2021 | Goodwin | A63B 59/54 |
| 11,097,171 | B2 | 8/2021 | Pegnatori | |
| 2002/0016230 | A1 | 2/2002 | Okuyama et al. | |
| 2002/0091022 | A1 | 7/2002 | Fritzke et al. | |
| 2002/0094892 | A1 * | 7/2002 | Chauvin | A63B 59/50 473/566 |
| 2004/0152545 | A1 | 8/2004 | Fritzke | |
| 2004/0166970 | A1 | 8/2004 | Sutherland | |
| 2004/0209711 | A1 | 10/2004 | Liberatore | |
| 2004/0209716 | A1 | 10/2004 | Vacek et al. | |
| 2005/0143203 | A1 | 6/2005 | Souders et al. | |
| 2006/0258490 | A1 | 11/2006 | Fitzgerald et al. | |
| 2007/0155546 | A1 | 7/2007 | Chauvin et al. | |
| 2007/0202973 | A1 | 8/2007 | Van | |
| 2007/0219027 | A1 | 9/2007 | Chong | |
| 2008/0064538 | A1 | 3/2008 | Mcnamee et al. | |
| 2008/0070726 | A1 * | 3/2008 | Watari | A63B 59/56 473/566 |
| 2009/0215559 | A1 | 8/2009 | Mcnamee et al. | |
| 2009/0280934 | A1 * | 11/2009 | Watari | A63B 59/50 473/566 |
| 2009/0280935 | A1 | 11/2009 | Watari et al. | |
| 2010/0029418 | A1 * | 2/2010 | Chen | A63B 59/56 473/564 |
| 2010/0113194 | A1 | 5/2010 | Tokieda | |
| 2011/0105255 | A1 | 5/2011 | Watari et al. | |
| 2011/0172038 | A1 | 7/2011 | Watari et al. | |
| 2012/0184402 | A1 | 7/2012 | Mcnamee et al. | |
| 2013/0267358 | A1 * | 10/2013 | Vaccaro, Jr. | A63B 60/10 473/566 |
| 2014/0073464 | A1 | 3/2014 | Van et al. | |
| 2014/0080641 | A1 * | 3/2014 | Epling | A63B 59/50 473/564 |
| 2014/0080642 | A1 | 3/2014 | Epling et al. | |
| 2014/0272245 | A1 | 9/2014 | Livingston-Peters et al. | |
| 2015/0005114 | A1 | 1/2015 | Tsukamoto et al. | |
| 2015/0040349 | A1 | 2/2015 | Malia et al. | |
| 2015/0105189 | A1 | 4/2015 | Schullstrom | |
| 2015/0157908 | A1 | 6/2015 | Van Nguyen et al. | |
| 2015/0360104 | A1 | 12/2015 | Chauvin et al. | |
| 2016/0184680 | A1 * | 6/2016 | Van Nguyen | A63B 60/54 473/520 |
| 2017/0340935 | A1 | 11/2017 | Gray et al. | |
| 2018/0169491 | A1 | 6/2018 | Gray et al. | |
| 2019/0143185 | A1 | 5/2019 | Hunt et al. | |
| 2019/0344140 | A1 | 11/2019 | Chauvin et al. | |
| 2020/0330838 | A1 * | 10/2020 | Goodwin | A63B 59/56 |
| 2020/0398128 | A1 | 12/2020 | Hunt et al. | |
| 2021/0268352 | A1 | 9/2021 | Montgomery et al. | |

OTHER PUBLICATIONS

ASTM International, "F2398-11: Standard Test Method for Measuring Moment of Inertia and Center of Percussion of a Baseball or Softball Bat" USA Baseball ABI Protocol, edition approved Apr. 1, 2011, published May 2011. 3 pages.

Canadian Intellectual Property Office, "Examiner's Report", for Canadian Application No. 3,032,371, dated Jun. 18, 2019, 3 pages.

Composites World, Carbon-Kevlar Hinge, Besting metal hardware in weight, thickness, 3X load capacity and 1 million fatigue cycles, available at https://www.compositesworld.com/blog/post/carbon-kevlar-hinge-. Oct. 30, 2017. 5 pages.

European Space Agency, "Passive Damped Deployment of Full Composite Structures" available at http://www.esa.int/Our_Activities/Space_Engineering_Technology/Shaping_the_Future/Passive_Damped_Deployment_of_Full_Composite_Structures. Exact publication date unknown; website visited Feb. 9, 2018. 2 pages.

Russell, Ph.D., Daniel., "Explaining the 98-mph BBS standard for ASA softball" Pennsylvania State University, Graduate Program in Acoustics, available at http://www.acs.psu.edu/drussell/bats/bbs-asa.html, Exact publication date unknown, last modified May 12, 2008, website visited Feb. 9, 2018. 6 pages.

Tech Briefs "Locking Mechanism for a Flexible Composite Hinge" available at https://www.techbriefs.com/component/content/article/tb/techbriefs/mechanics-and-machinery/26023, Dec. 1, 2016. 7 pages.

USPTO, "International Search Report and Written Opinion", for PCT/US2015/035959, dated Aug. 31, 2015, 6 pages.

USPTO, U.S. Appl. No. 14/307,312, Non-Final Office Action, dated Aug. 7, 2015, 6 pages.

Hunt, U.S. Appl. No. 14/307,312, Response to Nonfinal Office Action, dated Dec. 7, 2015, 15 pages.

USPTO, U.S. Appl. No. 14/307,312, Final Office Action, dated Jan. 21, 2016, 12 pages.

USPTO, U.S. Appl. No. 15/894,365, Non-Final Office Action, dated Jul. 20, 2018, 14 pages.

USPTO, U.S. Appl. No. 16/268,413, Non-Final Office Action, dated Apr. 24, 2019, 13 pages.

(56) References Cited

OTHER PUBLICATIONS

USPTO, U.S. Appl. No. 16/268,413, Final Office Action, dated Sep. 26, 2019, 11 pages.
U.S. Appl. No. 11/619,780, Unpublished patent application.
U.S. Appl. No. 60/864,409, Unpublished patent application.
Boombah, "2017 Boombah Boss Compressor T3 Bat Review", YouTube Video; URL: https://www.youtube.com/watch?v=aAFJAPkllSA, Jun. 2, 2017.
Boombah, "2017 Compressor T3 Slowpitch Bat", URL: https://www.boombah.com/us/equipment/bats/learn/2017-asa-boss-landing.html, web page visited Jan. 23, 2022.
Worth, "Fastpitch Bats", Excerpt from 2010 Catalog.
Worth, "Quad Baseball Bat", Excerpt from 2009 Catalog.

* cited by examiner

DOUBLE-BARREL BALL BATS

BACKGROUND

Ball bats, particularly composite ball bats, have been designed with various stiffness properties to meet the preferences of various players. Many players prefer the feel and performance of ball bats having barrels that exhibit high compliance (for example, high radial deflection) and low stiffness. There are challenges, however, in making an effective, durable ball bat having these properties. In addition, there are challenges in making a ball bat with high compliance that can meet league or association rules, such as rules associated with the Bat-Ball Coefficient of Restitution ("BBCOR"), the Batted-Ball Speed ("BBS") value, or other rules associated with collision efficiency of a bat and a ball.

Some existing double-barrel bats are structured in a manner that results in relatively heavier weight that may be undesirable for smaller, weaker, or younger players. For example, in bats having outer barrel shells installed over a frame, the length of the outer barrel tube may need to extend beyond the hitting area in order to provide a traditional look or feel of the bat, or to avoid a discontinuity, which may result in unnecessary weight.

SUMMARY

Representative embodiments of the present technology include a ball bat with an outer shell and an insert positioned in a ball striking area of the outer shell. The insert may include a tube element and one or more spacer elements positioned to form a gap between the tube element and the outer shell along at least a portion of a length of the tube element. In some embodiments, the insert or the gap may extend along no more than the length of the ball striking area. The outer shell may provide some compliance during a hit to create a trampoline effect, while the insert may provide a backstop to limit radial deflection of the outer shell.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to double-barrel ball bats and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to ball bats and composite materials, may not be shown or described in detail to avoid unnecessarily obscuring the relevant description of the various embodiments. Accordingly, embodiments of the present technology may include additional elements or exclude some of the elements described below with reference to FIGS. 1-8, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

For purposes of the present disclosure, a first element that is positioned "toward" an end of a second element is positioned closer to that end of the second element than to a middle or mid-length location of the second element.

Specific details of several embodiments of the present technology are described herein with reference to ball bats. Embodiments of the present technology can be used in baseball, softball, cricket, or similar sports.

Figure 1:
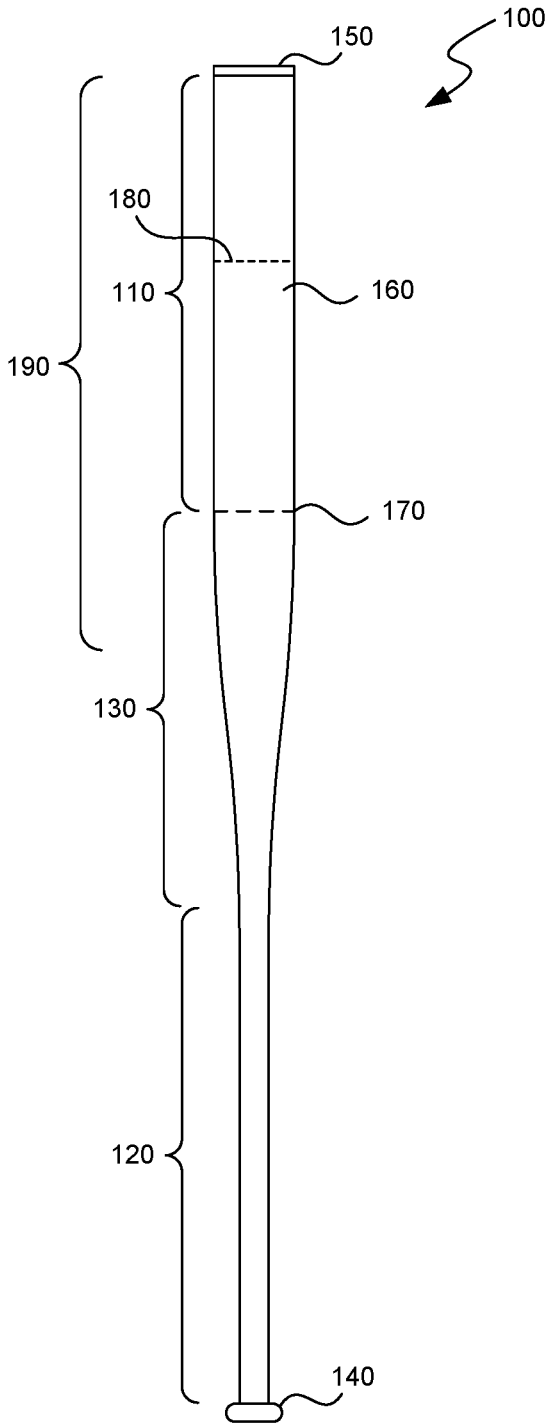
FIG. 1 illustrates a side view of a ball bat configured in accordance with embodiments of the present technology.

As shown in FIG. 1, a baseball or softball bat 100, hereinafter collectively referred to as a "ball bat" or "bat," includes a barrel portion 110 (constituting at least part of a hitting surface), a handle portion 120, and a tapered section 130 joining the handle portion 120 to the barrel portion 110. The tapered section 130 transitions the larger diameter of the barrel portion 110 to the narrower diameter of the handle portion 120. The tapered section 130 may include parts of the barrel portion 110 or the handle portion 120. The handle portion 120 optionally includes a knob 140 or similar structure positioned at a proximal end of the bat 100. The barrel portion 110 is optionally closed off by a suitable plug or end cap 150 positioned at a distal end of the bat 100. The interior of the bat 100 is optionally hollow, allowing the bat 100 to be relatively lightweight so that ball players may generate substantial bat speed when swinging the bat 100. The barrel portion 110 may include a non-tapered or straight section 160 extending between the end cap 150 and a location 170.

A ball striking area 190 of the bat 100 typically extends throughout the length of the barrel portion 110, and may extend partially into the tapered section 130 of the bat 100. The bat 100 generally includes a "sweet spot" 180, which is the impact location where the transfer of energy from the bat 100 to a ball is generally maximal, while the transfer of energy to a player's hands is generally minimal. The sweet spot 180 is typically located near the bat's center of percussion (COP), which may be determined by the ASTM F2398-11 Standard. For ease of measurement and description in the present application, the sweet spot 180 described herein coincides with the bat's COP.

The proportions of the bat 100, such as the relative sizes of the barrel portion 110, the handle portion 120, and the tapered section 130, are not drawn to scale and may have any relative proportions suitable for use in a ball bat. Accordingly, the bat 100 may have any suitable dimensions. For example, the bat 100 may have an overall length of 20 to 40 inches, or 26 to 34 inches. The overall barrel portion 110 diameter may be 2.0 to 3.0 inches, or 2.25 to 2.75 inches. Typical ball bats have barrel diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the ball bat 100, and may vary greatly among users.

Components of the ball bat 100 may be constructed from one or more composite or metallic materials. Some examples of suitable composite materials include laminate layers or plies reinforced with fibers of carbon, glass, graphite, boron, aramid (such as Kevlar®), ceramic, or silica (such as Astroquartz®). In some embodiments, aluminum, titanium, or another suitable metallic material may be used to construct portions of, or all of, the ball bat 100.

Figure 2:
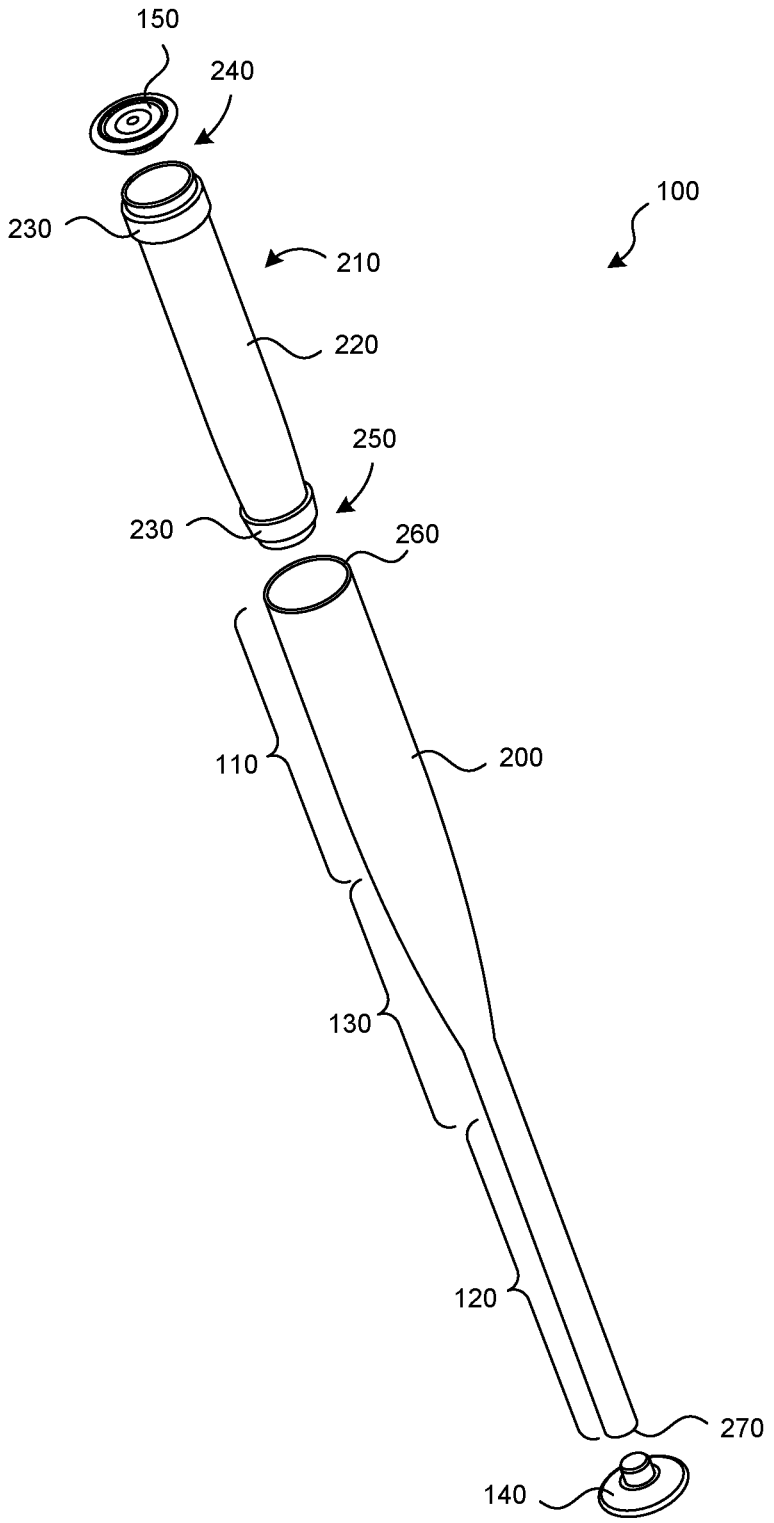
FIG. 2 illustrates a perspective exploded view of the ball bat shown in FIG. 1.
Figure 3:
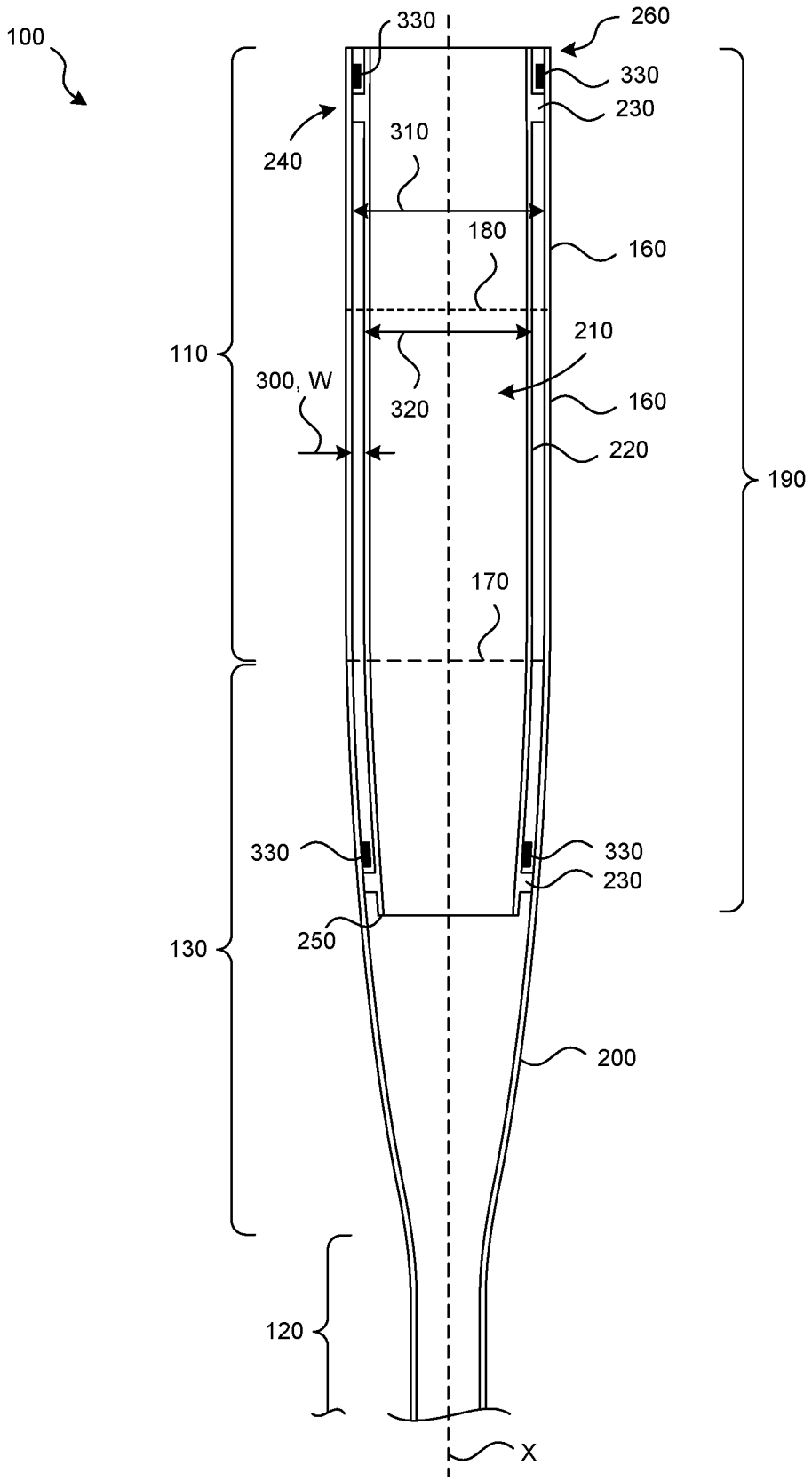
FIG. 3 illustrates a cross-sectional view of a portion of the ball bat shown in FIGS. 1 and 2.

Turning to FIGS. 2 and 3, the ball bat 100 includes an outer shell 200 and an insert 210 positioned within the outer shell 200. The outer shell 200 may include the barrel portion 110 (which includes a distal end 260 of the outer shell 200), the handle portion 120 (which includes a proximal end 270 of the outer shell 200), and the tapered section 130. The outer shell 200 may form an outer barrel in a double-barrel structure, while the insert 210 may form an inner barrel. The insert 210 may include a hollow tube element 220 and one or more (for example, two) spacer elements 230 positioned on or integral with the tube element 220. The tube element 220 may extend between a first or distal end 240 of the insert 210 and a second or proximal end 250 of the insert 210. The tube element 220 may be formed from one or more of the composite or metallic materials described above, or with other suitable materials. The outer shell 200 may be formed with the same materials as, or different materials from, the materials in the tube element 220.

The spacer elements 230 may include complete or partial rings or protrusions extending beyond an outer diameter of the tube element 220. One or more of the spacer elements 230 may be positioned toward the distal end 240 of the insert 210, and one or more of the spacer elements 230 may be positioned toward the proximal end 250 of the insert 210. In some embodiments, additional spacer elements may be positioned between the distal end 240 and the proximal end 250. The tube element 220 or the overall insert 210 may be tapered from a larger diameter at its distal end 240 to a smaller diameter at its proximal end 250. For example, the tube element 220 or the overall insert 210 may taper to have a shape that corresponds to a shape of the hollow interior of the outer shell 200. In some embodiments, the tube element 220 or the overall insert 210 may include a straight section and a tapered section shaped similarly to, but smaller than, a portion of the outer shell 200.

When the ball bat 100 is assembled, the end cap 150 may be attached to the distal end 260 of the outer shell 200 or to the insert 210. The optional end knob 140 may be attached to or formed integrally with the proximal end 270 of the outer shell 200. A double-barrel bat constructed in this manner may have a general look and feel of a traditional bat with a smooth outer contour because the insert 210 is concealed within the outer shell 200. In other words, a single-piece outer shell 200 avoids a contour discontinuity that may be found in other bat designs.

FIG. 3, which is a cross-sectional view of a portion of the ball bat 100, shows the insert 210 in an assembled position in the outer shell 200. The insert 210 may coextend with some, most, or all of the ball striking area 190, or it may extend beyond the ball striking area 190. In some embodiments, the insert 210 may extend only along most or all of the straight section 160. In some embodiments, the insert 210 may extend beyond the straight section 160 into the tapered section 130. For example, the distal end 240 of the insert 210 may be positioned in the distal end 260 of the outer shell 200, and the proximal end 250 of the insert 210 may be positioned in the tapered section 130 of the outer shell 200, such that the insert 210 extends between the distal end 260 of the outer shell 200 and a location within the tapered section 130. In some embodiments, the distal end 240 of the insert 210 may be flush with the distal end 260 of the outer shell 200. In other embodiments, the distal end 240 of the insert 210 may be recessed into the distal end 260 of the outer shell 200.

The tube element 220 is spaced apart from the outer shell 200 along at least a portion of a length of the tube element 220 between the spacer elements 230 to form a gap 300 between the tube element 220 and the outer shell 200. Accordingly, the barrel portion 110 of the outer shell 200 forms an outer bat barrel that is substantially separated or spaced apart from the tube element 220 of the insert 210 by the gap 300. The spacer elements 230 maintain the gap 300 and they may contribute to maintaining concentricity between the insert 210 and the outer shell 200. The gap 300 results from the outer shell 200 having a larger inner diameter 310 than an outer diameter 320 of the tube element 220 along at least portions of the length of the tube element 220. One or more additional spacer elements 230 may be positioned in the gap 300 to form optional breaks or interruptions in the gap 300 along the bat's length.

In some embodiments, the outer shell 200 provides some compliance during a hit to create a trampoline effect, while the insert 210 provides a backstop to limit the radial deflection of the outer shell 200. Positioning the insert 210 within the interior of the outer shell 200 allows a bat designer to provide an insert 210 that is only as long as needed to provide a backstop to the outer shell 200. For example, in some embodiments, the gap 300 or the insert 210 may only extend along the portion of the length of the bat 100 that generally coincides with the ball striking area 190. Limiting the length of the insert 210 to only what is needed to provide a backstop for the outer shell 200 helps limit weight of the overall bat 100. Further, because the insert 210 is positioned in the interior of the outer shell 200, there may be no external discontinuity in the outer contour of the bat 100 where the insert 210 ends (the same may be true in a multiple-piece outer shell, described in additional detail below). Ball bats according to various embodiments of the present technology provide improved hitting feel and sound, and they may provide reduced shock or vibration for improved player comfort, while facilitating reduced weight relative to other double-barrel designs.

Each spacer element 230 may be in the form of a partial or complete ring positioned between the tube element 220 and the outer shell 200. In some embodiments, one or more of the spacer elements 230 may be discrete elements attached to the tube element 220 or the outer shell 200 (for example, bonded with adhesive or otherwise attached). In some embodiments, one or more of the spacer elements 230 may be integral with the tube element 220 or the outer shell 200. For example, the material forming the tube element 220 may be molded or machined to include one or more contours or projections along the length of the tube element 220 to form the shape of one or more of the spacer elements 230. The tube element 220 may be made of a composite material, and the spacer elements 230 may be integrally formed with the same composite material or with different composite material from the tube element 220. In general, the spacer elements 230 are projections extending radially outward from the tube element 220, or radially inward from the outer shell 200. Although two spacer elements 230 are illustrated in FIGS. 2 and 3, bats configured in accordance with embodiments of the present technology may include more or fewer spacer elements 230. In some embodiments, one or more of the spacer elements 230 may have a different structure or composition than one or more of the other spacer elements 230.

One or more of the spacer elements 230 may be relatively hard (for example, formed with aluminum, fiber in an epoxy, polycarbonate, or other relatively hard materials). In some embodiments, one or more of the spacer elements 230 may be relatively soft (for example, having a hardness value less than Shore 90A). In some embodiments, one or more of the spacer elements 230 can include natural rubber, polyurethane, foamed polyurethane, thermoplastic polyurethane, or other elastomeric, resilient, or relatively soft materials. In some embodiments, a ball bat 100 may include a relatively hard spacer element 230 positioned toward the distal end 240 of the insert 210, a relatively hard spacer element 230 positioned toward the proximal end 250 of the insert 210, and one or more relatively soft spacer elements positioned between relatively hard spacer elements 230.

In some embodiments, the width W of the gap 300 may be between approximately 0.05 inches and 0.2 inches at one or more (such as all) positions between the spacer elements 230, although other embodiments may include different dimensions. In some embodiments, the width W of the gap 300 may be uniform along its length. In other embodiments, the width W may vary along its length. The gap width W may be varied along its length by varying the inner diameter of the outer shell 200, varying the outer diameter of the tube element 220 of the insert 210, or by positioning materials in the gap 300 on the tube element 220 or in the outer shell 200. In some embodiments in which limited performance may be desired (for example, to comply with performance regulations), the gap width W may be smaller near the sweet spot 180 than on either side of the sweet spot 180.

Dimensions of the gap (such as the gap width W) may be selected depending on desired performance characteristics. For example, in some embodiments, the gap width W at the sweet spot 180 may be between 0.010 inches and 0.020 inches, or other suitable dimensions. In some embodiments, a soft material may span a portion of the distance between the tube element 220 and the outer shell 200. In some embodiments, a soft material may span the full distance between the tube element 220 and the outer shell 200, thereby filling the gap 300. Suitable soft materials may include elastomeric materials having shore hardness less than 85D, or other suitable values. Suitable soft materials may include, for example, polyurethane (such as thermoplastic polyurethane), rubber, ethylene propylene diene rubber (EPDM), nitrile butadiene rubber (NBR), isoprene rubber (IR), isobutylene isoprene rubber (IIR), thermoplastic rubber (TPR), thermoplastic elastomer (TPE), thermoplastic olefin elastomer (TPO), vinyl, ethylene vinyl acetate (EVA), vinyl nitrile (VN), expanded polypropylene (EPP), neoprene, silicone, silicone rubber, or other materials suitable for providing a cushion between the tube element 220 and the outer shell 200.

In various bats 100 configured in accordance with embodiments of the present technology, materials and dimensions may be selected to create a desired level of flex and compression of the ball striking area 190 of the outer shell 200 relative to the tube element 220 of the insert 210 (for example, the amount of trampoline effect). For example, the position, spacing, and composition of the spacer elements 230, the width W of the gap 300, the thickness and composition of material(s) in the tube element 220 of the insert 210, or the thickness and composition of material(s) in the outer shell 200 may be selected individually or in various combinations to create the desired level of flex and compression of the outer shell 200 relative to one or more of the components of the insert 210 (including the tube element 220 and the spacer elements 230). The various properties may also be determined based on maximizing durability of the bat 100.

In some embodiments, the outer shell 200 may be formed with an elastomeric composite material or a composite layup of the outer shell 200 may include one or more layers or plies of elastomeric composite material. For example, the barrel portion 110 of the outer shell 200 may include an elastomeric matrix material reinforced with one or more reinforcing fibers (for example, individual fibers, weaves of fibers, or meshes of fibers) made of carbon, glass, polyester, graphite, boron, aramid (such as Kevlar®), ceramic, silica (such as Astroquartz®), or other reinforcing elements.

In the art of ball bat design, designers may measure compression values by determining the amount of force required to compress a cylinder or ball bat in a radial direction. For example, designers may rely on compression values based on testing under the ASTM F2844-11 Standard Test Method for Displacement Compression of Softball and Baseball Bat Barrels.

Compression values of the tube element 220 and the outer shell 200 may be selected to tune the feel or trampoline effect of the assembled ball bat 100. In some embodiments, the outer shell 200 may have a lower (such as significantly lower) compression value than the compression value of the tube element 220 of the insert 210. For example, the tube element 220 may have a compression value that is two to three times greater (or more) than the compression value of some or all of the ball striking area 190 of the outer shell 200. In some embodiments, the tube element 220 may have a compression value that is two to three times greater (or more) than the compression value of some or all of the straight section 160. Such an arrangement (in which the tube element 220 has a greater compression value than the ball striking area or the straight section) may be beneficial in softball bats, or in youth baseball bats regulated by their "Bat Performance Factor" (also called "BPF," which is a regulatory measure based on how fast the ball comes off the bat after a hit). In some embodiments, the outer shell 200 may have a higher compression value than that of the tube element 220 (such as two to three times greater, or more). Such an arrangement may be beneficial in baseball bats (for example, to comply with BBCOR regulations). In further embodiments, the compression values of the outer shell 200 and the tube element 220 may be generally the same. In yet further embodiments, the compression values of the outer shell 200 or the tube element 220 may vary along the longitudinal axis X of the bat 100. Relative compression values may depend on factors such as durability, performance requirements, or performance regulations.

The insert 210 may be bonded to the outer shell 200 (for example, via adhesive between one or more of the spacer elements 230 and the outer shell 200) to assist with holding the insert 210 in the outer shell 200. Bats 100 configured in accordance with some embodiments of the present technology may additionally or alternatively include one or more locking elements 330 (such as two locking elements 330) attached to the outer shell 200 to impede or prevent the insert 210 from exiting the outer shell 200. A locking element 330 may be positioned between a spacer element 230 and the distal end 260 of the outer shell 200. In some embodiments, a locking element 330 may be positioned adjacent to a spacer element 230. In some embodiments, a locking element 330 may extend from the inside of the outer shell 200 by a distance of approximately 0.005 inches to 0.025 inches, or another suitable distance that is less than or equal to the gap width W.

A locking element 330 may be formed by positioning additional composite material in the interior of the outer shell 200 during layup of the outer shell 200 to form integral raised bumps or a ring on the interior of the outer shell 200. The outer shell 200 may be configured to be sufficiently flexible to allow the insert 210 to be pressed into the outer shell 200 with enough force to expand the outer shell 200 to allow the spacer elements 230 to pass the locking element(s) 330. After the spacer elements 230 have snapped past the locking element(s) 330, the outer shell 200 contracts to hold the insert 210 in place. Axial loads experienced in normal or even harsh play would generally be insufficient to force the insert 210 back out of place.

Figure 4:
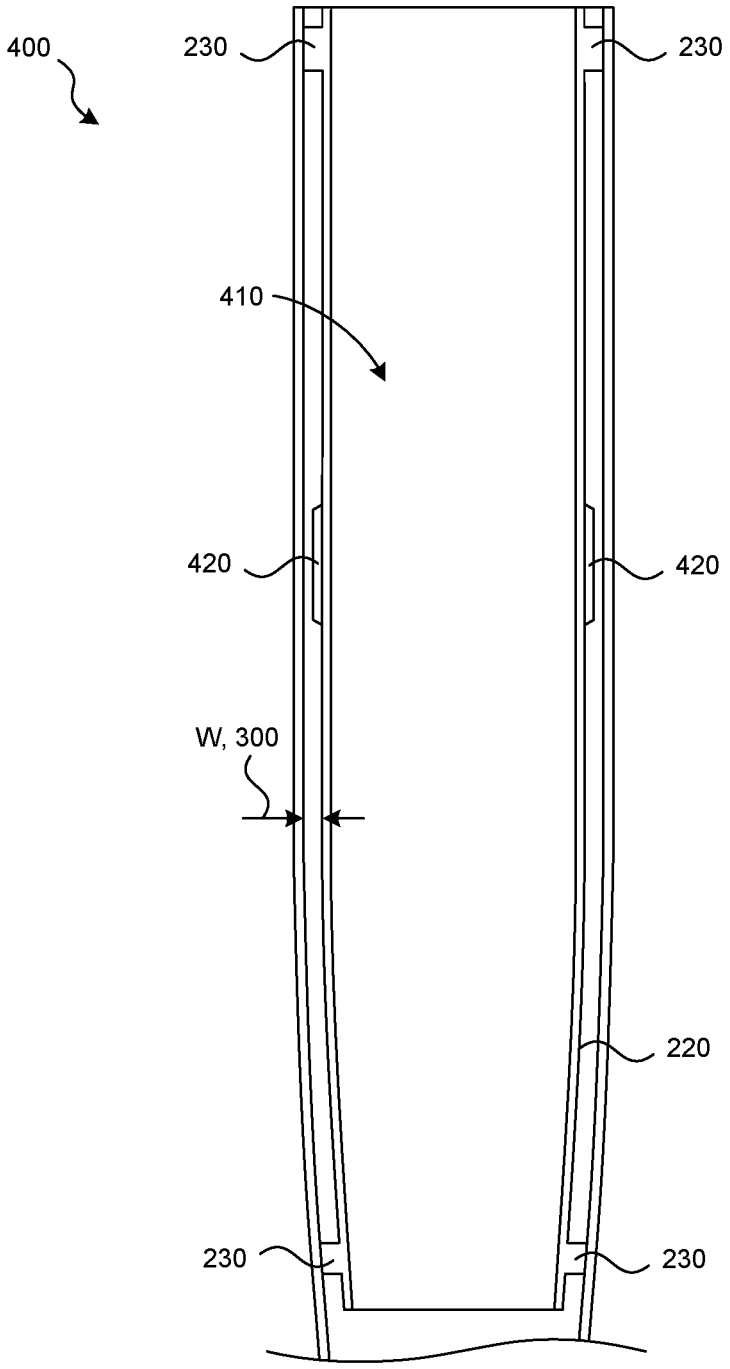
FIG. 4 illustrates a cross-sectional view of a portion of a ball bat configured in accordance with another embodiment of the present technology.

FIG. 4 illustrates a cross-sectional view of a portion of a ball bat 400 configured in accordance with another embodiment of the present technology. The ball bat 400 is similar to the ball bat 100 described above with regard to FIGS. 1-3 in most aspects, except that the insert 410 includes a sleeve element 420 positioned on the tube element 220. In some embodiments, the sleeve element 420 may extend one to three inches, or other distances, along the length of the tube element 220. The sleeve element 420 may be positioned near the sweet spot 180 (for example, the sleeve element 420 may be positioned at, or centered about, the sweet spot 180) to further control performance by acting as a soft or hard backstop to limit movement of the outer shell 200 during impact with a ball. In some embodiments, the sleeve may be an integral part of the tube element 220, for example, it may be laid up with the other composite materials forming the tube element 220. The sleeve element 420 may span only a portion of the width W of the gap 300 or, in some embodiments, it may occupy the entire width W of the gap 300. In some embodiments, the sleeve element 420 may include natural rubber, polyurethane, foamed polyurethane, thermoplastic polyurethane, or other elastomeric, resilient, soft, or stiff materials. The material forming the sleeve element 420 may be selected to tune the bat for various regulations (such as BBCOR or BPF). For example, in a bat that requires compliance with BBCOR rules, the sleeve element 420 may include a relatively soft material. In a bat that is focused on maximizing performance, the sleeve element 420 can include a relatively hard material.

In some embodiments, one or more additional spacer elements 230 may be positioned on the tube element 220 where the sleeve 420 is positioned, either in addition to or in place of the sleeve 420. Such additional spacer elements 230 may extend into the gap 300 the same distance as one or more (such as all) of the other spacer elements 230, or they may be smaller or larger than one or more (such as all) of the other spacer elements 230. Additional spacer elements 230 may be bonded or unbonded to the tube element 220 or the outer shell 200.

Figure 5A:
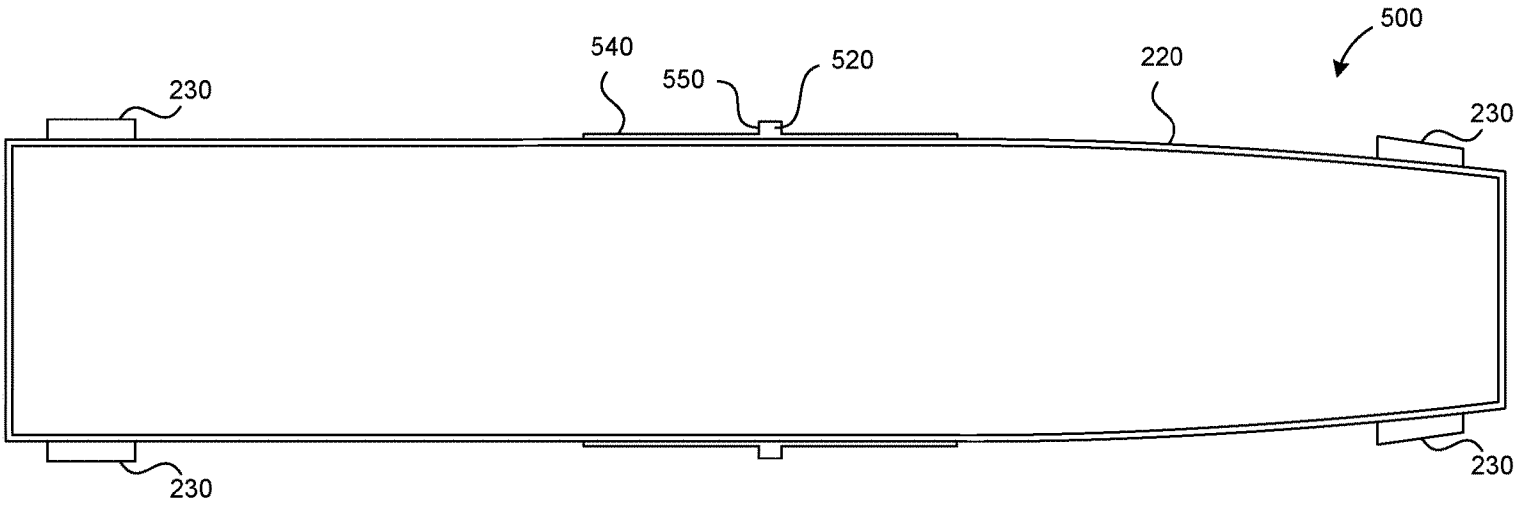
FIGS. 5A and 5B illustrate cross-sectional views of inserts for ball bats configured in accordance with embodiments of the present technology.
Figure 5B:
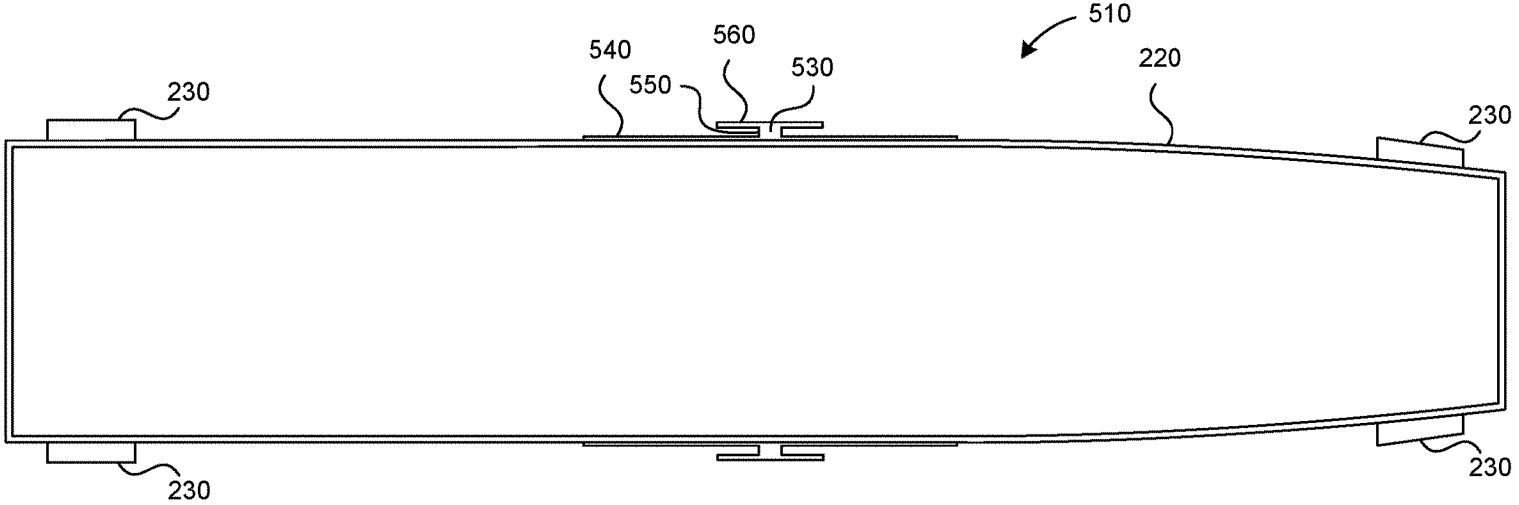

FIGS. 5A and 5B illustrate cross-sectional views of inserts 500, 510 configured in accordance with further embodiments of the present technology. The inserts 500, 510 are similar to the inserts 210, 410 described above with regard to FIGS. 2-4 in most aspects, except that the inserts 500, 510 may include different sleeve elements 520, 530. For example, as generally illustrated in FIG. 5A, a sleeve element 520 may include a base portion 540 extending along part of the tube element 220 (and having a shape similar to the sleeve element 420 described above with regard to FIG. 4) and a transversely extending (such as radially extending) portion 550. As generally illustrated in FIG. 5B, a sleeve element 530 may include a base portion 540 extending along part of the tube element 220 (and having a shape similar to the sleeve element 420 described above with regard to FIG. 4), a transversely extending (such as radially extending) portion 550, and a flange portion 560, such that the cross-section of the sleeve element 530 generally resembles an I-beam. Sleeve elements configured in accordance with embodiments of the present technology may contact the outer shell 200 or they may be spaced apart from the outer shell 200.

Figure 6:
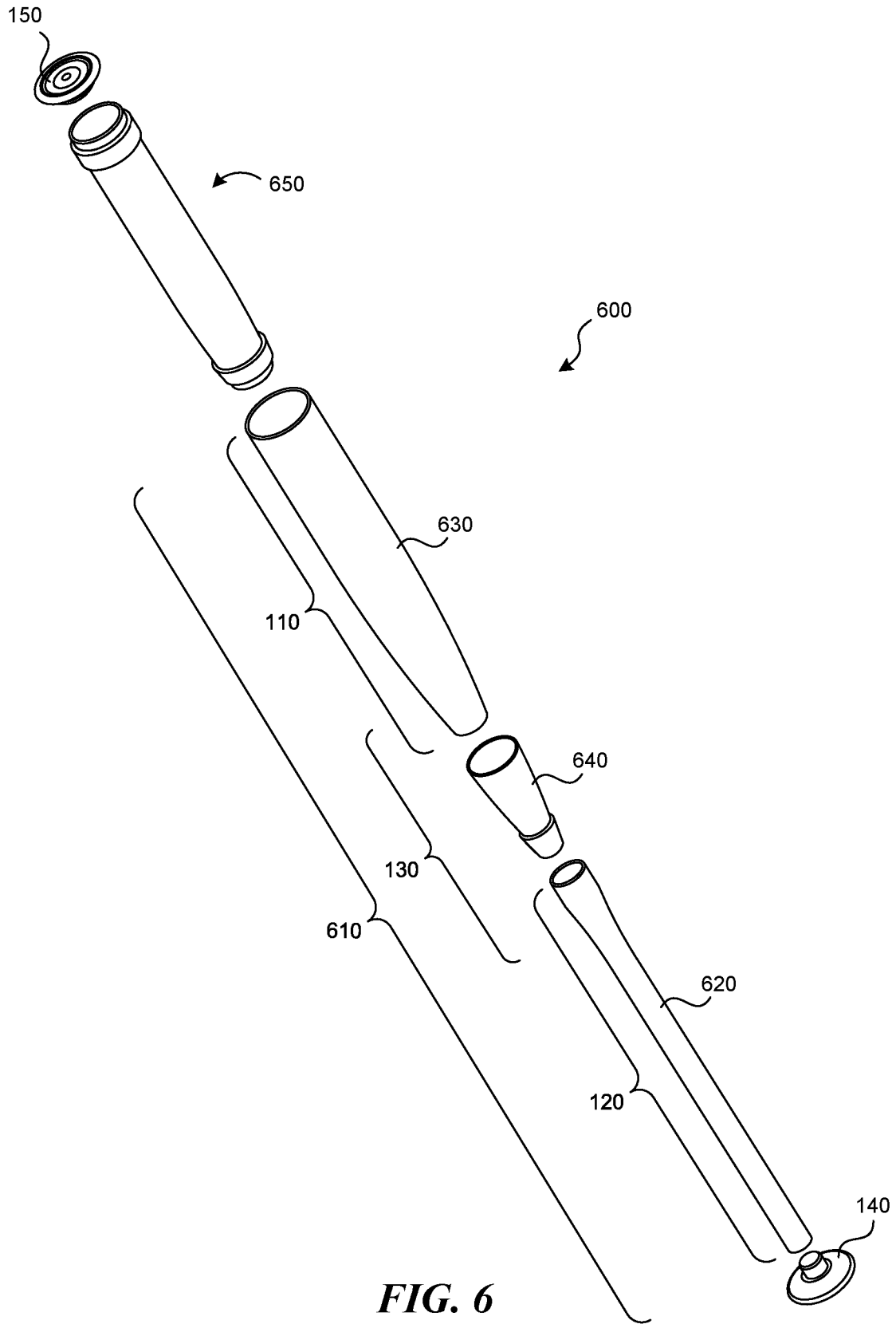
FIG. 6 illustrates a perspective exploded view of a ball bat configured in accordance with further embodiments of the present technology.

FIG. 6 illustrates a perspective exploded view of a ball bat 600 configured in accordance with further embodiments of the present technology. The ball bat 600 is similar to the ball bat 100 described above with regard to FIGS. 1-3 in most aspects, except that the outer shell 610 of the ball bat 600 is formed with two or more separate attached segments. For example, a handle segment 620 of the outer shell 610 may include some or all of the handle portion 120 and may be separate from, but attached to, a barrel segment 630 of the outer shell 610. The barrel segment 630 may include some or all of the barrel portion 110. In some embodiments, a segment of the outer shell 610 that includes the handle portion 120 may include a portion of the tapered section 130, and a segment of the outer shell 610 that includes the barrel portion 110 may also include a portion of the tapered section 130. The handle segment 620 may be directly attached to the barrel segment 630 or, in some embodiments, the handle segment 620 may be attached to the barrel segment 630 with a connecting element 640 positioned between the handle segment 620 and the barrel segment 630.

An insert 650 may be positioned in the outer shell 610. The insert 650 and its position in the outer shell 610 may be similar to the inserts 210, 410, 500, 510 described above with regard to FIGS. 2, 4, 5A, and 5B.

The barrel portion 110 may be formed with one or more composite or metal materials. The handle portion 120 may be formed from the same materials as the barrel portion 110, or the handle portion 120 may be formed with different materials. In some embodiments, the handle portion 120 may be formed with a metal material and the barrel portion 110 may be formed with a composite material. In some embodiments, the barrel portion 110 may be formed with a metal material and the handle portion 120 may be formed with a composite material. In some embodiments, both the barrel portion 110 and the handle portion 120 may be formed with a composite material, or both the barrel portion 110 and the handle portion 120 may be formed with a metal material.

A double-barrel bat that has an inner frame and an external barrel sleeve positioned on the frame may require the external barrel sleeve to extend beyond the ball striking area toward the knob end of the bat in order to avoid a discontinuity in the wall of the ball striking area. In contrast, because inserts (such as the insert 650) configured in accordance with embodiments of the present technology are positioned inside the outer shell, the inserts need not extend much beyond (if at all beyond) the ball striking area. Accordingly, embodiments of the present technology allow for omission of material from the inserts toward the knob end of the bat, which saves weight. The ball striking area of the bat may be extended relative to other bats due to the insert 650 not needing to be as long as an external barrel sleeve. Embodiments of the present technology also allow the optional connecting element 640 to be larger because the size of the insert 650 may be minimized. In some embodiments, the optional connecting element 640 may extend within the full inner diameter of the outer shell 610, which may improve durability or strength of the connecting element 640.

Figure 7:
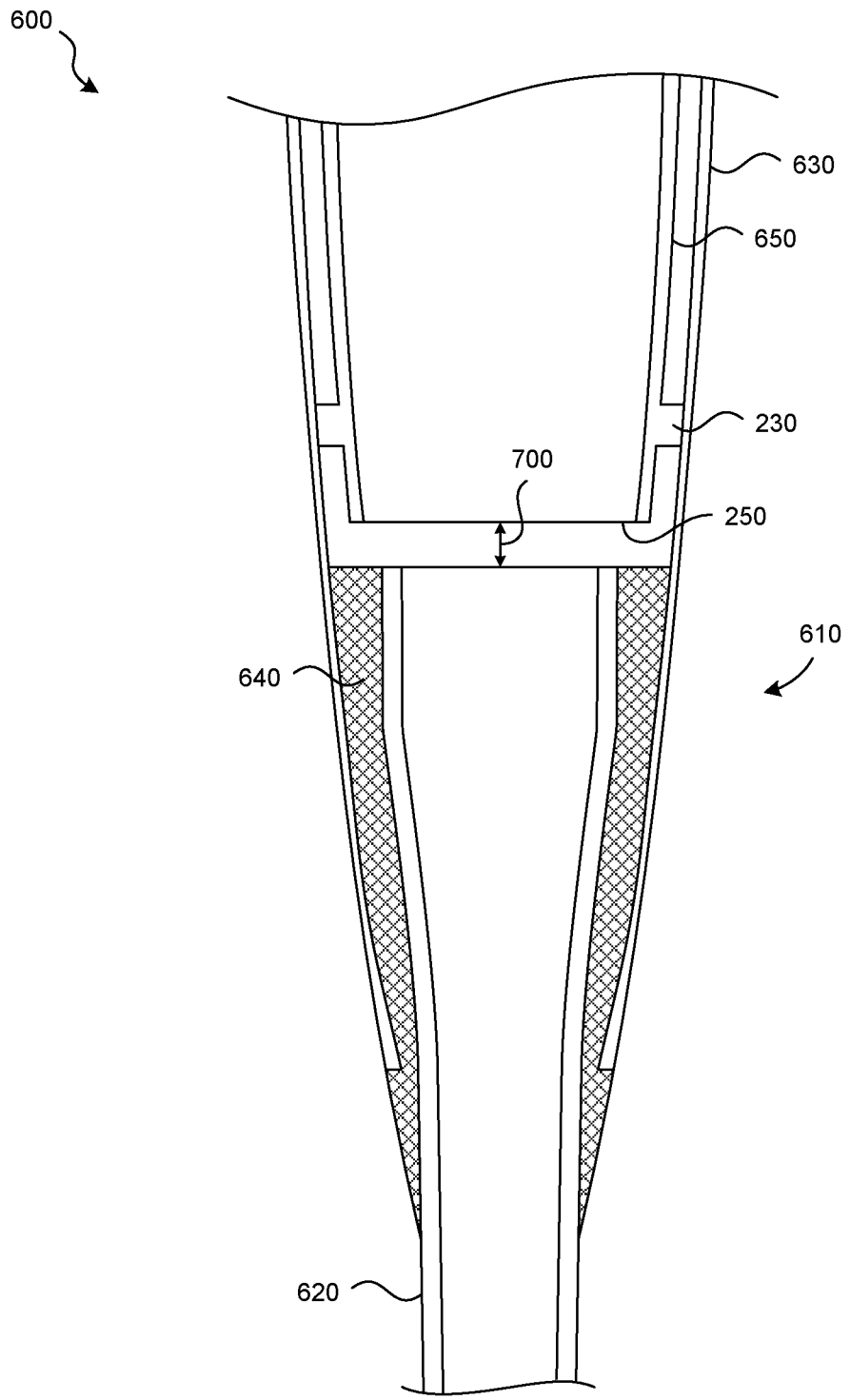
FIG. 7 illustrates a cross-sectional view of a portion of the ball bat shown in FIG. 6.

FIG. 7 illustrates a cross-sectional view of a portion of the ball bat 600 shown in FIG. 6. The insert 650 may be spaced apart from the handle segment 620 on the interior of the bat 600 by a longitudinal gap 700. The gap 700 is formed in part as a result of the insert 650 not reaching the handle segment 620, which reduces or minimizes weight of the insert 650. In some embodiments, the length of the gap 700 along the longitudinal axis of the bat may be determined at least in part by a position of the spacer element 230 located closest to the proximal end 250 of the insert 650. In some embodiments, the spacer element 230 located closest to the proximal end 250 of the insert 650 may be positioned at a distance of approximately 0.25 inches to 0.5 inches from the proximal end 250 of the insert 650. In some embodiments, the closer the spacer element 230 is to the proximal end 250, the more material may be omitted from the proximal end 250 of the insert (and thus, the resulting gap 700 may be larger or the overall bat may weigh less).

Figure 8:
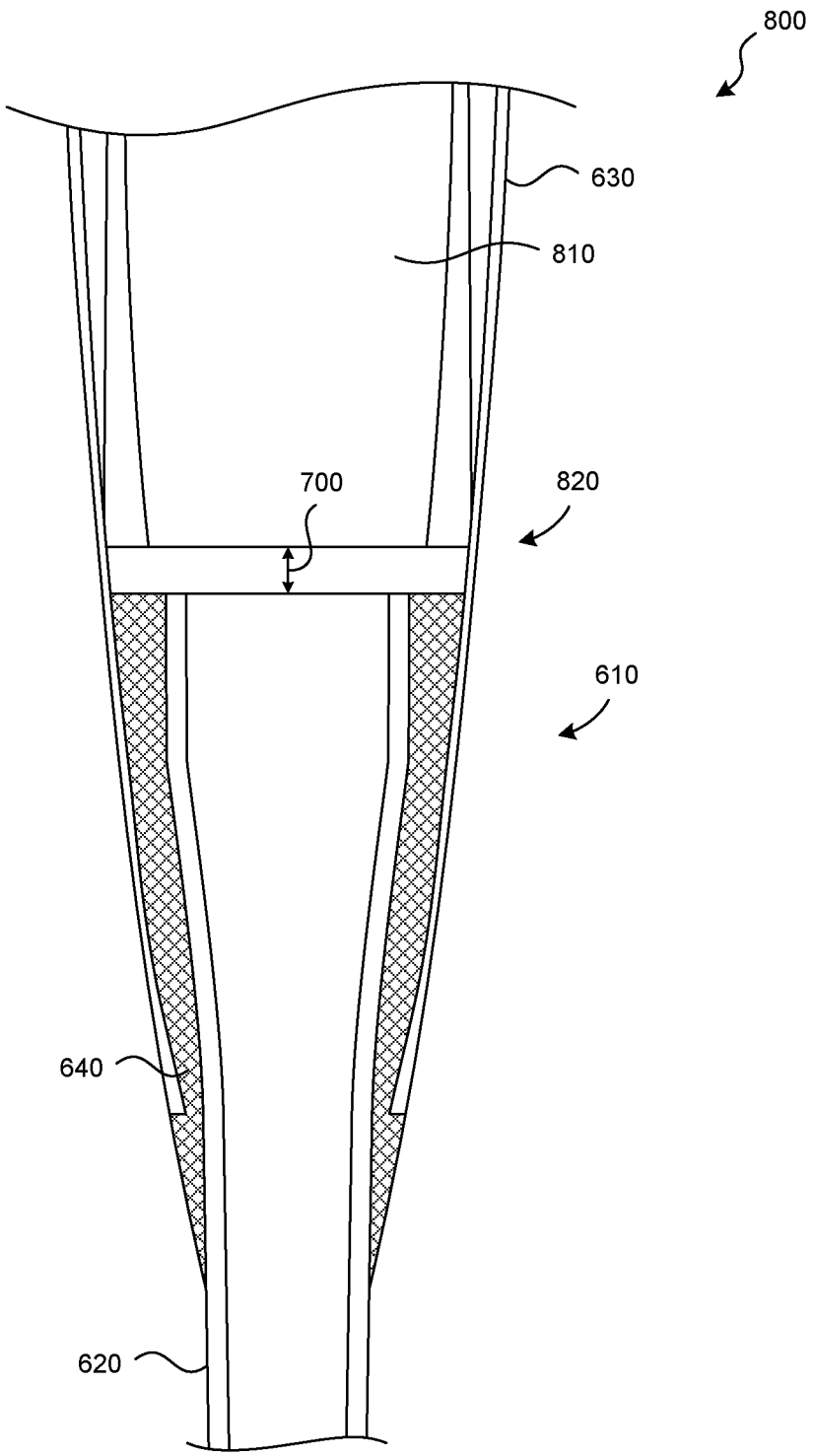
FIG. 8 illustrates a cross-sectional view of a portion of a ball bat configured in accordance with further embodiments of the present technology.

FIG. 8 illustrates a cross-sectional view of a portion of a ball bat 800 configured in accordance with further embodiments of the present technology. The bat 800 is similar to the ball bat 600 described above with regard to FIGS. 6 and 7, and it may include an insert 810 similar to the inserts described above, except that the insert 810 may omit one or more spacer elements at the proximal end 820 of the insert 810. In some embodiments, the proximal end 820 of the insert 810 may be tapered to have a contact surface that engages the interior surface of the barrel segment 630. The proximal end 820 may be bonded (for example, with adhesive) to the interior surface of the barrel segment 630. In some embodiments, the proximal end 820 may have a press-fit or interference fit with the barrel segment 630. Although the insert 810 is shown in a bat 800 with a multiple-piece outer shell 610, in some embodiments, the insert 810 (which omits one or more spacer elements) may be implemented in a bat having a single-piece outer shell, such as the bat 100 described above with regard to FIG. 2, or in other bat configurations.

Bats configured in accordance with embodiments of the present technology provide several advantages. Embodiments of the present technology facilitate a relatively large gap between the insert and the outer shell, which allows for a relatively flexible outer shell. The outer shell provides a trampoline effect that is limited by the insert, which provides a backstop to limit the range of motion of the outer shell to reduce fatigue and failure of the outer shell and to maintain compliance with performance regulations. The double-barrel structure facilitates construction of an outer shell with a much lower compression value than the barrel wall of single-barrel structures (such as 40 percent to 70 percent less), while still providing durability to survive testing and normal play.

Embodiments of the present technology also provide reduced weight (while maintaining double-barrel bat characteristics) in part because the barrel insert need not extend much beyond the hitting area of the bat. In some representative embodiments, the present technology facilitates weight savings between 0.5 ounces and 4.0 ounces. Bats configured in accordance with embodiments of the present technology may further facilitate relatively large-barrel bats in baseball because of the reduction in weight. Bats configured in accordance with embodiments of the present technology also provide reduced shock relative to traditional ball bats.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, in bats intended for use in softball, the outer shell may be formed with a very flexible composite material, which may provide high performance. In bats intended for use in baseball, where performance limitations may be lower or more regulated (such as in the NCAA or in USA Baseball, which regulate a lower performance value), the outer shell may optionally be made of a metal material so that the barrel shell is stiffer (for example, as stiff as a solid wood bat).

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A ball bat, comprising:

an outer shell comprising a barrel segment that includes at least part of a barrel portion of the outer shell, a handle segment that includes at least part of a handle portion of the outer shell, and a tapered section between the barrel portion and the handle portion, wherein the handle segment is separate from, but attached to, the barrel segment, and wherein the barrel portion includes a distal end of the outer shell and the handle portion includes a proximal end of the outer shell; and an insert comprising a tube element extending along a longitudinal axis of the bat between a first end of the insert and a second end of the insert, the insert further comprising a first spacer element positioned toward the first end of the insert and a second spacer element positioned toward the second end of the insert;

wherein:

the first end of the insert is positioned in the distal end of the outer shell and the second end of the insert is positioned in the tapered section of the outer shell;

the tube element is spaced apart from the outer shell along at least a portion of a length of the tube element between the first and second spacer elements to form a gap between the tube element and the outer shell; and the insert is spaced apart from the handle segment along the longitudinal axis of the bat.

2. The ball bat of claim 1, further comprising one or more additional spacer elements positioned on the tube element between the first and second spacer elements.

3. The ball bat of claim 1, wherein at least one of the first spacer element or the second spacer element is integral with the tube element.

4. The ball bat of claim 1, wherein the barrel portion and the tube element comprise one or more layers of composite laminate material.

5. The ball bat of claim 1, further comprising one or more locking elements positioned on an inner diameter of the outer shell and positioned to impede removal of the insert from the outer shell.

6. The ball bat of claim 1, wherein the barrel portion of the outer shell comprises an elastomeric composite material including an elastomeric matrix material reinforced with reinforcing fibers.

7. The ball bat of claim 1, further comprising a connecting element that attaches the handle segment to the barrel segment.

8. The ball bat of claim 7, wherein the insert is spaced apart from the connecting element along the longitudinal axis of the bat.

9. The ball bat of claim 1, further comprising a sleeve element positioned on the tube element in the gap, wherein the sleeve element is positioned at a center of percussion of the ball bat.

10. The ball bat of claim 1, wherein the barrel portion comprises a first compression value and the tube element comprises a second compression value that is higher than the first compression value.

11. A ball bat, comprising:

a single-piece outer shell comprising a barrel portion formed with one or more layers of composite laminate material, a handle portion, and a tapered section joining the barrel portion to the handle portion, wherein the barrel portion includes a distal end of the outer shell and the handle portion includes a proximal end of the outer shell; and an insert comprising a tube element extending between a first end of the insert and a second end of the insert, the insert further comprising a first spacer element positioned toward the first end of the insert and a second spacer element positioned toward the second end of the insert, wherein at least one of the first spacer element or the second spacer element is integral with the tube element;

wherein the first end of the insert is positioned in the distal end of the outer shell and the second end of the insert is positioned in the tapered section of the outer shell;

and wherein the tube element is spaced apart from the outer shell along at least a portion of a length of the tube element between the first and second spacer elements to form a gap between the tube element and the outer shell.

12. The ball bat of claim 11, wherein the tube element is molded to include the second spacer element.

13. A ball bat comprising:

an outer shell comprising a barrel portion formed with one or more layers of composite laminate material, a handle portion, and a tapered section joining the barrel portion to the handle portion, wherein the barrel portion includes a distal end of the outer shell and the handle portion includes a proximal end of the outer shell; and an insert comprising a tube element extending between a first end of the insert and a second end of the insert, the insert further comprising a spacer element positioned toward the first end of the insert; wherein:

the first end of the insert is positioned in the distal end of the outer shell, and the second end of the insert is positioned in the tapered section of the outer shell;

the tube element is spaced apart from the outer shell along at least a portion of a length of the tube element between the spacer element and the second end of the insert to form a gap between the tube element and the outer shell; and the second end of the insert contacts an interior surface of the tapered section of the outer shell.

14. The ball bat of claim 13, wherein the second end of the insert is bonded to the interior surface of the tapered section of the outer shell.

* * * * *